US011800269B2

(12) United States Patent
Steele

(10) Patent No.: US 11,800,269 B2
(45) Date of Patent: *Oct. 24, 2023

(54) SYSTEMS AND METHODS FOR ON EAR DETECTION OF HEADSETS

(71) Applicant: Cirrus Logic International Semiconductor Ltd., Edinburgh (GB)

(72) Inventor: Brenton Steele, Blackburn South (AU)

(73) Assignee: Cirrus Logic Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/545,456

(22) Filed: Dec. 8, 2021

(65) Prior Publication Data

US 2022/0103921 A1 Mar. 31, 2022

Related U.S. Application Data

(63) Continuation of application No. 16/724,034, filed on Dec. 20, 2019, now Pat. No. 11,240,578.

(51) Int. Cl.
*H04R 1/04* (2006.01)
*H04R 1/10* (2006.01)
(Continued)

(52) U.S. Cl.
CPC ..... *H04R 1/04* (2013.01); *H04R 1/1016* (2013.01); *H04R 1/265* (2013.01); *H04R 29/006* (2013.01)

(58) Field of Classification Search
CPC ..... H04R 1/04; H04R 1/1016; H04R 1/265; H04R 29/006
(Continued)

(56) References Cited

U.S. PATENT DOCUMENTS

2008/0298600 A1 12/2008 Poe
2009/0268936 A1 10/2009 Goldberg et al.
(Continued)

OTHER PUBLICATIONS

International Search Report and Written Opinion of the International Searching Authority, International Application No. PCT/GB2020/053224, dated Jul. 13, 2021.

*Primary Examiner* — Paul Kim
*Assistant Examiner* — Con P Tran
(74) *Attorney, Agent, or Firm* — Jackson Walker L.L.P

(57) ABSTRACT

Described embodiments generally relate to a signal processing device for on ear detection for an earbud. The device comprises a first microphone input for receiving a microphone signal from a first microphone, the first microphone being configured to be positioned within an ear of a user when the earbud is being worn; a second microphone input for receiving a microphone signal from a second microphone, the second microphone being configured to be positioned outside the ear of the user when the earbud is being worn; a signal generator configured to generate a signal for acoustic playback from a speaker configured to be positioned within the earbud; and a processor. The processor is configured to receive at least one first microphone signal from each of the first microphone input and the second microphone input, and compare the first microphone signals to determine the on ear status of the earbud; determine that the on ear status of the earbud cannot be sufficiently determined, generate a signal for acoustic playback from the speaker, receive a second microphone signal from the first microphone input, and compare the second microphone signal to the generated signal to determine the on ear status of the earbud.

25 Claims, 7 Drawing Sheets

(51) Int. Cl.
*H04R 1/26* (2006.01)
*H04R 29/00* (2006.01)

(58) Field of Classification Search
USPC ..... 381/91, 122, 111, 58, 56, 380, 74, 96, 381/375; 455/41.2, 569.1
See application file for complete search history.

(56) References Cited

U.S. PATENT DOCUMENTS

| | | | |
|---|---|---|---|
| 2010/0189268 | A1 | 7/2010 | Haartsen et al. |
| 2014/0037101 | A1 | 2/2014 | Murata et al. |
| 2016/0372104 | A1 | 12/2016 | Nystrom |
| 2019/0174218 | A1 | 6/2019 | Kumar et al. |
| 2019/0189129 | A1 | 6/2019 | Arakawa et al. |

SYSTEMS AND METHODS FOR ON EAR DETECTION OF HEADSETS

The present disclosure is a continuation of U.S. Non-Provisional patent application Ser. No. 16/724,034, filed Dec. 20, 2019, which is incorporated by reference herein in its entirety.

TECHNICAL FIELD

Embodiments generally relate to systems and methods for determining whether or not a headset is located on or in an ear of a user, and to headsets configured to determine whether or not the headset is located on or in an ear of a user.

BACKGROUND

Headsets are a popular device for delivering sound and audio to one or both ears of a user. For example, headsets may be used to deliver audio such as playback of music, audio files or telephony signals. Headsets typically also capture sound from the surrounding environment. For example, headsets may capture the user's voice for voice recording or telephony, or may capture background noise signals to be used to enhance signal processing by the device. Headsets can provide a wide range of signal processing functions.

For example, one such function is Active Noise Cancellation (ANC, also known as active noise control) which combines a noise cancelling signal with a playback signal and outputs the combined signal via a speaker, so that the noise cancelling signal component acoustically cancels ambient noise and the user only or primarily hears the playback signal of interest. ANC processing typically takes as inputs an ambient noise signal provided by a reference (feed-forward) microphone, and a playback signal provided by an error (feed-back) microphone. ANC processing consumes appreciable power continuously, even if the headset is taken off.

Thus in ANC, and similarly in many other signal processing functions of a headset, it is desirable to have knowledge of whether the headset is being worn at any particular time. For example, it is desirable to know whether on-ear headsets are placed on or over the pinna(e) of the user, and whether earbud headsets have been placed within the ear canal(s) or concha(e) of the user. Both such use cases are referred to herein as the respective headset being "on ear". The unused state, such as when a headset is carried around the user's neck or removed entirely, is referred to herein as being "off ear".

Previous approaches to on ear detection include the use of dedicated sensors such as capacitive, optical or infrared sensors, which can detect when the headset is brought onto or close to the ear. Another previous approach to on ear detection is to provide a sense microphone positioned to detect acoustic sound inside the headset when worn, on the basis that acoustic reverberation inside the ear canal and/or pinna will cause a detectable rise in power of the sense microphone signal as compared to when the headset is not on ear. However, the sense microphone signal power can be affected by loud ambient noise from noise sources such as traffic, and so this approach can output a false positive that the headset is on ear when in fact the headset is off ear and affected by noise. These and other approaches to on ear detection can also output false positives when the headset is held in the user's hand, placed in a box, or the like.

It is desired to address or ameliorate one or more shortcomings or disadvantages associated with prior systems and methods for determining whether or not a headset is in place on or in the ear of a user, or to at least provide a useful alternative thereto.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this document, a statement that an element may be "at least one of" a list of options is to be understood to mean that the element may be any one of the listed options, or may be any combination of two or more of the listed options.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

Some embodiments relate to a signal processing device for on ear detection for an earbud, the device comprising:

- a first microphone input for receiving a microphone signal from a first microphone, the first microphone being configured to be positioned within an ear of a user when the earbud is being worn;
- a second microphone input for receiving a microphone signal from a second microphone, the second microphone being configured to be positioned outside the ear of the user when the earbud is being worn;
- a signal generator configured to generate a signal for acoustic playback from a speaker configured to be positioned within the earbud; and
- a processor configured to:
  - receive at least one first microphone signal from each of the first microphone input and the second microphone input, and compare the first microphone signals to determine the on ear status of the earbud;
  - determine that the on ear status of the earbud cannot be sufficiently determined, generate a signal for acoustic playback from the speaker, receive a second microphone signal from the first microphone input, and compare the second microphone signal to the generated signal to determine the on ear status of the earbud.

Some embodiments further comprise a proximity sensor, and wherein the processor is further configured to receive at least one sensor signal from the proximity sensor indicating that the earbud is in proximity to an object, and to perform the steps of receiving at least one first microphone signals and comparing the first microphone signals to determine the on ear status of the earbud in response to receiving the at least one sensor signal from the proximity sensor. According to some embodiments, the proximity sensor is an infra-red sensor.

According to some embodiments, comparing the first microphone signals to determine the on ear status of the earbud comprises comparing the power level of the first microphone signals. In some embodiments, comparing the first microphone signals to determine the on ear status of the earbud further comprises determining that the earbud is on ear if the power of the first microphone signal received from the first microphone is lower than the first microphone signal received from the second microphone by a predetermined threshold.

In some embodiments, comparing the first microphone signals to determine the on ear status of the earbud further comprises determining that the earbud is off ear if the power of the first microphone signal received from the first microphone is higher than the first microphone signal received from the second microphone by a predetermined threshold.

In some embodiments, comparing the first microphone signals to determine the on ear status of the earbud further comprises determining that the on ear status of the earbud cannot be sufficiently determined if the power level of each of the first microphone signals is lower than a predetermined threshold.

According to some embodiments, comparing the at least one second microphone signal to the generated signal to determine the on ear status of the earbud comprises determining whether the at least one second microphone signal comprises resonance of the generated signal.

In some embodiments, the generated signal is an audible probe signal. According to some embodiments, the generated signal is of a frequency known to resonate in the human ear canal.

In some embodiments, the processor is further configured to perform an audio processing function in response to the determined on ear status of the earbud.

Some embodiments relate to a method of on ear detection for an earbud, the method comprising:

- receiving a first microphone signal from a first microphone and a first microphone signal from a second microphone, wherein the first microphone is configured to be positioned within an ear of a user when the earbud is being worn and the second microphone is configured to be positioned outside the ear of the user when the earbud is being worn;
- comparing the first microphone signals to determine the on ear status of the earbud;
- determining that the on ear status of the earbud cannot be sufficiently determined, generating a signal for acoustic playback from a speaker configured to be positioned within the earbud, receiving a second microphone signal from the first microphone, and comparing the second microphone signal to the generated signal to determine the on ear status of the earbud.

Some embodiments further comprise receiving at least one sensor signal from a proximity sensor indicating that the earbud is in proximity to an object, and performing the steps of receiving at least one first microphone signals and comparing the first microphone signals to determine the on ear status of the earbud in response to receiving the at least one sensor signal from the proximity sensor.

According to some embodiments, comparing the first microphone signals to determine the on ear status of the earbud comprises comparing the power level of the first microphone signals. In some embodiments, comparing the first microphone signals to determine the on ear status of the earbud further comprises determining that the earbud is on ear if the power of the first microphone signal received from the first microphone is lower than the first microphone signal received from the second microphone by a predetermined threshold.

According to some embodiments, comparing the first microphone signals to determine the on ear status of the earbud further comprises determining that the earbud is off ear if the power of the first microphone signal received from the first microphone is higher than the first microphone signal received from the second microphone by a predetermined threshold.

In some embodiments, comparing the first microphone signals to determine the on ear status of the earbud further comprises determining that the on ear status of the earbud cannot be sufficiently determined if the power level of each of the first microphone signals is lower than a predetermined threshold.

In some embodiments, comparing the at least one second microphone signal to the generated signal to determine the on ear status of the earbud comprises determining whether the at least one second microphone signal comprises resonance of the generated signal.

According to some embodiments, the generated signal is an audible probe signal. In some embodiments, the generated signal is of a frequency known to resonate in the human ear canal.

Some embodiments further comprise performing an audio processing function in response to the determined on ear status of the earbud.

Some embodiments relate to a signal processing device for on ear detection of an earbud, the device comprising:

- a first microphone input for receiving a microphone signal from a first microphone, the first microphone being configured to be positioned within an ear of a user when the earbud is being worn;
- a second microphone input for receiving a microphone signal from a second microphone, the second microphone being configured to be positioned outside the ear of the user when the earbud is being worn;
- a signal generator configured to generate a signal for acoustic playback from a speaker configured to be positioned within the earbud; and
- a processor configured to:
  - generate a signal for acoustic playback from the speaker;
  - cause the signal to be played by the speaker;
  - receive at least one microphone signal from each of the first microphone input and the second microphone input, and compare the received microphone signals with the generated signal played by the speaker to detect resonance of the generated signal; and
  - determine the on ear status of the earbud;
- wherein the earbud is determined to be on ear only if resonance is detected in the signal from the first microphone input but is not detected in the signal from the second microphone input.

According to some embodiments, the generated signal is an audible probe signal. According to some embodiments, the generated signal is of a frequency known to resonate in the human ear canal.

In some embodiments, the processor is further configured to filter the received microphone signals with a bandpass filter prior to comparing the received microphone signals. In some embodiments, the bandpass filter is matched to the frequency of the generated signal.

According to some embodiments, the processor is configured to only compare the filtered signals after a predetermined time period has elapsed from the time at which the generated signal was emitted from the speaker.

In some embodiments, comparing the received microphone signals with the generated signal played by the speaker to detect resonance of the generated signal comprises subtracting a power level of the microphone signal received from the second microphone and a power level of the generated signal from the power level of the microphone signal received from the first microphone, and comparing the resultant power level with a predetermined threshold.

According to some embodiments, the processor is further configured to perform an audio processing function in response to the determined on ear status of the earbud.

Some embodiments relate to a method for on ear detection of an earbud, the method comprising:

generating a signal for acoustic playback from a speaker configured to be positioned within the earbud;

causing the signal to be played by the speaker;

receiving at least one microphone signal from a first microphone and a second microphone, wherein the first microphone is configured to be positioned within an ear of a user when the earbud is being worn and the second microphone is configured to be positioned outside the ear of the user when the earbud is being worn;

comparing the received microphone signals with the generated signal played by the speaker to detect resonance of the generated signal; and determining the on ear status of the earbud, wherein the earbud is determined to be on ear only if resonance is detected in the signal from the first microphone input but is not detected in the signal from the second microphone input.

In some embodiments, the generated signal is an audible probe signal. According to some embodiments, the generated signal is of a frequency known to resonate in the human ear canal.

Some embodiments further comprise filtering the received microphone signals with a bandpass filter prior to comparing the received microphone signals. In some embodiments, the bandpass filter is matched to the frequency of the generated signal.

Some embodiments further comprise comparing the filtered signals only after a predetermined time period has elapsed from the time at which the generated signal was emitted from the speaker.

According to some embodiments, comparing the received microphone signals with the generated signal played by the speaker to detect resonance of the generated signal comprises subtracting a power level of the microphone signal received from the second microphone and a power level of the generated signal from the power level of the microphone signal received from the first microphone, and comparing the resultant power level with a predetermined threshold.

Some embodiments further comprise performing an audio processing function in response to the determined on ear status of the earbud.

Some embodiments relate to machine-readable medium storing non-transitory instructions which, when executed by one or more processors, cause an electronic apparatus to perform the method of some other embodiments.

Some embodiments relate to an apparatus, comprising processing circuitry and a non-transitory machine-readable which, when executed by the processing circuitry, cause the apparatus to perform the method of some other embodiments.

Some embodiments relate to a system for on ear detection for an earbud, the system comprising a processor and a memory, the memory containing instructions executable by the processor and wherein the system is operative to perform the method of some other embodiments.

BRIEF DESCRIPTION OF DRAWINGS

Embodiments are described in further detail below, by way of example and with reference to the accompanying drawings, in which.

DETAILED DESCRIPTION

Embodiments generally relate to systems and methods for determining whether or not a headset is located on or in an ear of a user, and to headsets configured to determine whether or not the headset is located on or in an ear of a user.

Some embodiments relate to a hybrid on ear detection technique, where a headset first operates in a low power listening mode or passive mode and performs a first attempt at making an on ear determination. If a determination cannot be made, such as if the ambient acoustic environment is too quiet, the headset moves to a relatively high power active mode that requires a probe signal to be generated, and then performs a second attempt at making an on ear determination. Such a hybrid technique may allow for more certainty than when using a proximity sensor or passive detection techniques alone, by using an active detection technique as a last resort without requiring probe signals to be constantly emitted.

Some embodiments further relate to a high power or active on ear detection technique that reduces false positive results that may arise when an earbud is contained within a small enclosed environment, such as being cupped in a user's hand, by comparing internal and external microphone signals in response to application of an audible resonating probe signal, rather than by looking at the internal microphone signal alone.

Figure 1:
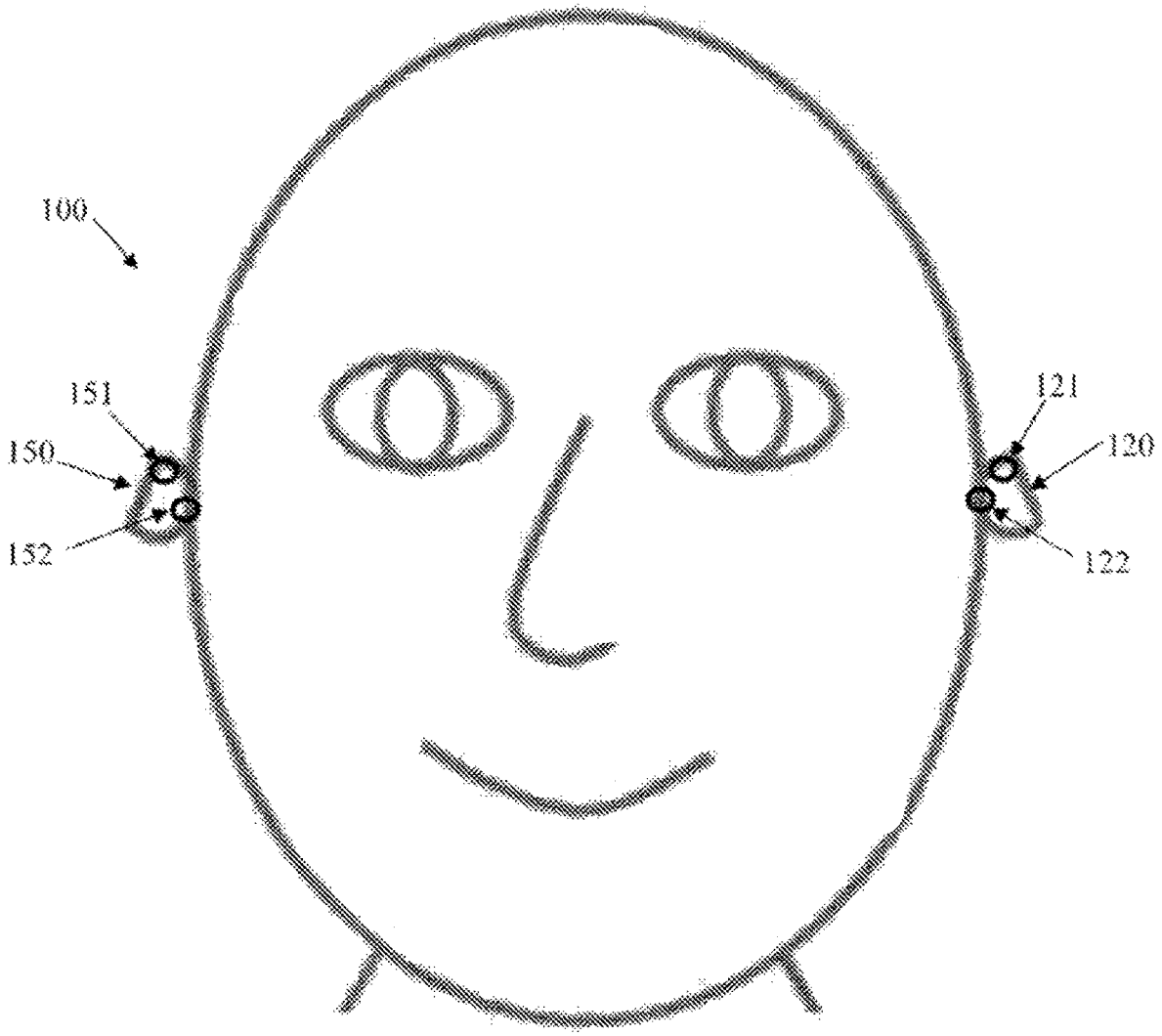
FIG. 1 illustrates a signal processing system comprising a headset in which on ear detection is implemented according to some embodiments.

FIG. 1 illustrates a headset 100 in which on ear detection is implemented. Headset 100 comprises two earbuds 120 and 150, each comprising two microphones 121, 122 and 151, 152, respectively. Headset 100 may be configured to determine whether or not each earbud 120, 150 is located in or on an ear of a user.

Figure 2:
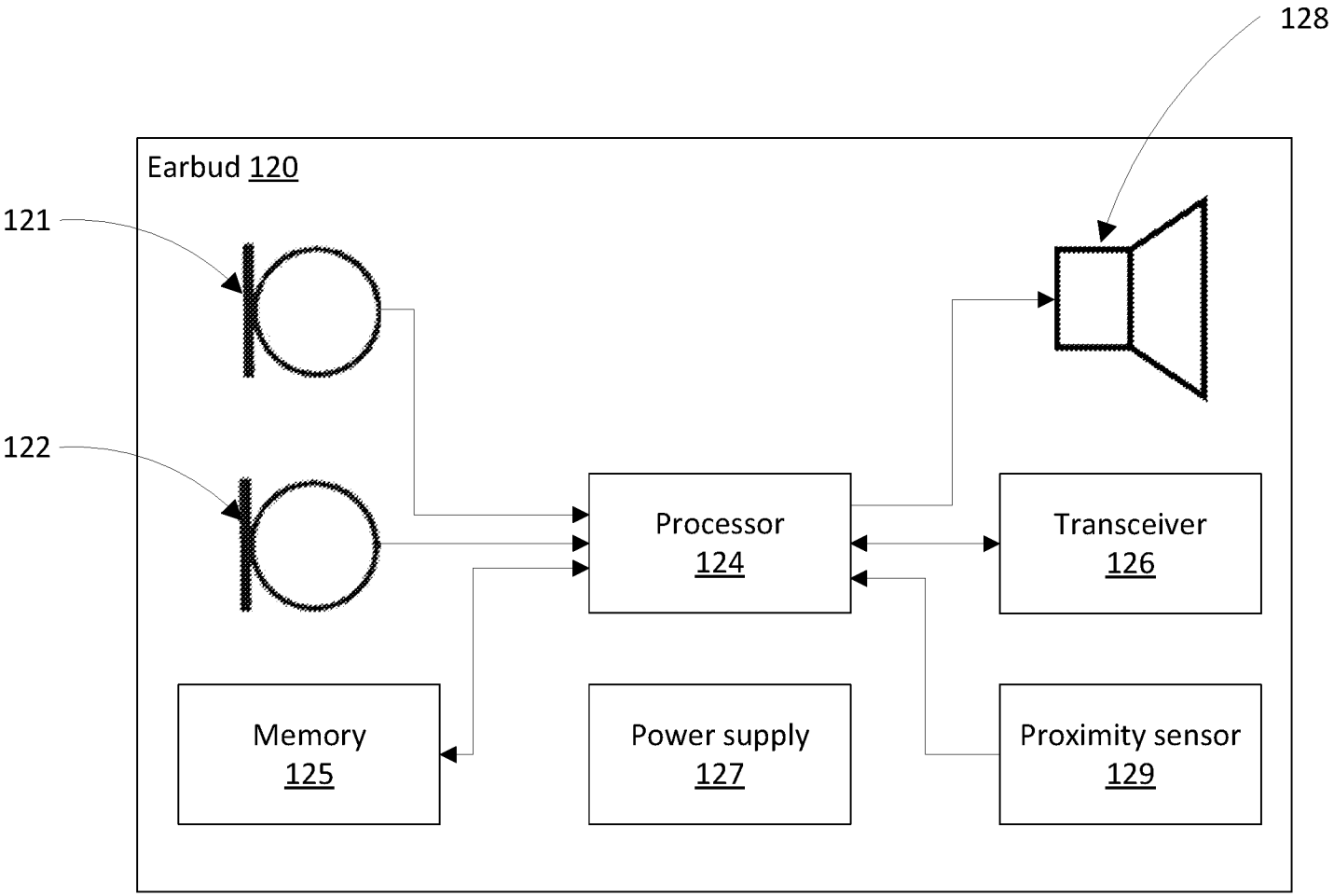
FIG. 2 shows a block diagram showing the hardware components of an earbud of the headset of FIG. 1.

FIG. 2 is a system schematic showing the hardware components of earbud 120 in further detail. Earbud 150 comprises substantially the same components as earbud 120, and is configured in substantially the same way. Earbud 150 is thus not separately shown or described.

As well as microphones 121 and 122, earbud 120 comprises a digital signal processor 124 configured to receive microphone signals from earbud microphones 121 and 122. Microphone 121 is an external or reference microphone and is positioned to sense ambient noise from outside the ear canal and outside of the earbud when earbud 120 is positioned in or on an ear of a user. Conversely, microphone 122 is an internal or error microphone and is positioned inside the ear canal so as to sense acoustic sound within the ear canal when earbud 120 is positioned in or on an ear of the user.

Earbud 120 further comprises a speaker 128 to deliver audio to the ear canal of the user when earbud 120 is positioned in or on an ear of a user. When earbud 120 is positioned within the ear canal, microphone 122 is occluded to at least some extent from the external ambient acoustic environment, but remains well coupled to the output of speaker 128. In contrast, microphone 121 is occluded to at least some extent from the output of speaker 128 when earbud 120 is positioned in or on an ear of a user, but remains well coupled to the external ambient acoustic environment. Headset 100 may be configured to deliver music or audio to a user, to allow a user to make telephone calls, and to deliver voice commands to a voice recognition system, and other such audio processing functions.

Processor 124 is further configured to adapt the handling of such audio processing functions in response to one or both earbuds 120, 150 being positioned on the ear, or being removed from the ear. For example, processor 124 may be configured to pause audio being played through headset 100 when processor 124 detects that one or more earbuds 120, 150 have been removed from a user's ear(s). Processor 124 may be further configured to resume audio being played through headset 100 when processor 124 detects that one or more earbuds 120, 150 have been placed on or in a user's ear(s).

Earbud 120 further comprises a memory 125, which may in practice be provided as a single component or as multiple components. The memory 125 is provided for storing data and program instructions readable and executable by processor 124, to cause processor 124 to perform functions such as those described above. Earbud 120 further comprises a transceiver 126, which allows the earbud 120 to communicate with external devices. According to some embodiments, earbuds 120, 150 may be wireless earbuds, and transceiver 126 may facilitate wireless communication between earbud 120 and earbud 150, and between earbuds 120, 150 and an external device such as a music player or smart phone. According to some embodiments, earbuds 120, 150 may be wired earbuds, and transceiver 126 may facilitate wired communications between earbud 120 and earbud 150, either directly such as within an overhead band, or via an intermediate device such as a smartphone. According to some embodiments, earbud 120 may further comprise a proximity sensor 129 configured to send signals to processor 124 indicating whether earbud 120 is located in proximity to an object, and/or to measure the proximity of the object. Proximity sensor 129 may be an infrared sensor or an infrasonic sensor in some embodiments. According to some embodiments, earbud 120 may have other sensors, such as movement sensors or accelerometers, for example. Earbud 120 further comprises a power supply 123, which may be a battery according to some embodiments.

Figure 3:
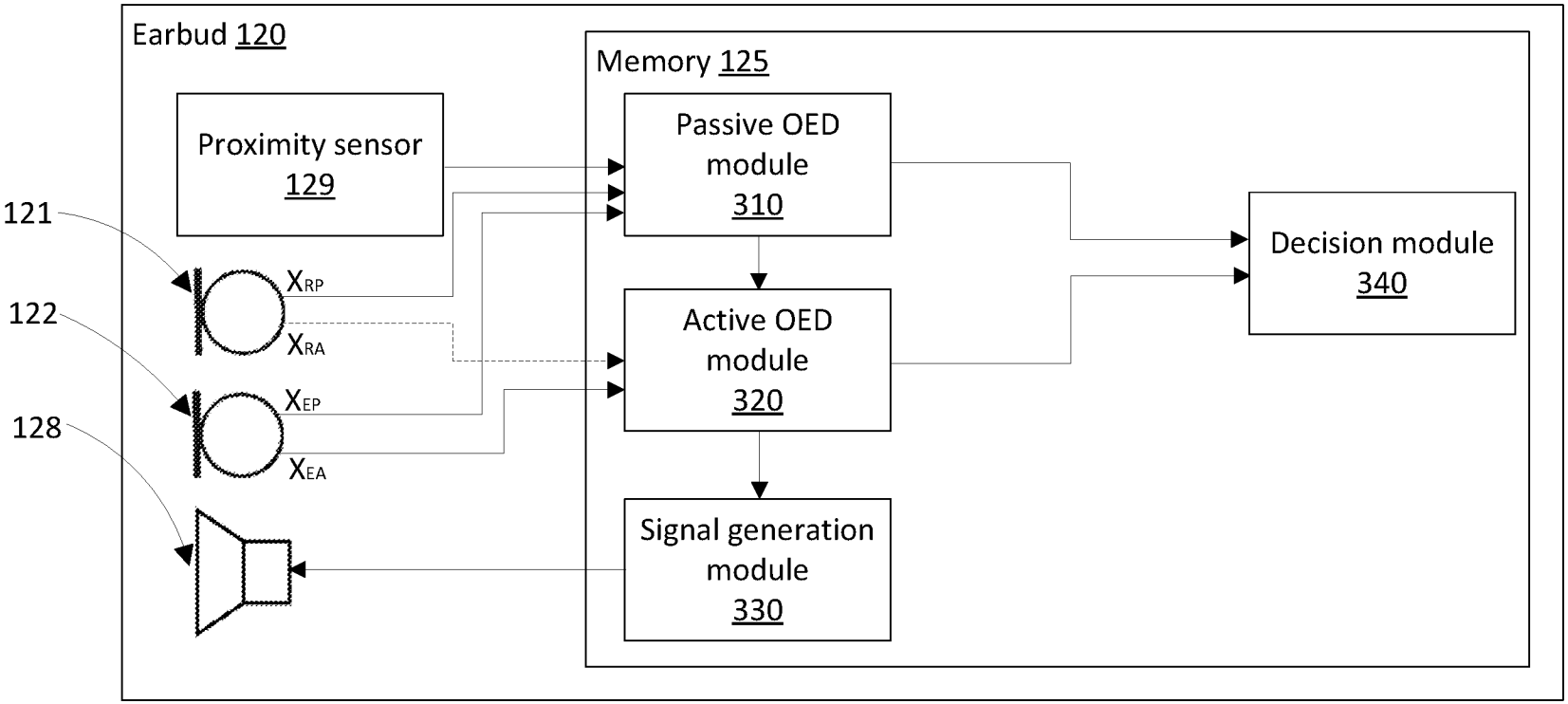
FIG. 3 shows a block diagram showing the software modules of the earbud of the headset of FIG. 1.

FIG. 3 is a block diagram showing executable software modules stored in memory 125 of earbud 120 in further detail, and further illustrating a process for on ear detection in accordance with some embodiments. FIG. 3 shows microphones 121 and 122, as well as speaker 128 and proximity sensor 129. Proximity sensor 129 may be an optional component in some embodiments. Reference microphone 121 generates passive signal $X_{RP}$ based on detected ambient sounds when no audio is being played via speaker 128. When audio is being played via speaker 128, reference microphone 121 generates active signal $X_{RA}$ based on detected sounds, which may include ambient sounds as well as sounds emitted by speaker 128. Error microphone 122 generates passive signal $X_{EP}$ based on detected ambient sounds when no audio is being played via speaker 128. When audio is being played via speaker 128, error microphone 122 generates active signal $X_{EA}$ based on detected sounds, which may include ambient sounds as well as sounds emitted by speaker 128.

Memory 125 stores passive on ear detection module 310 executable by processor 124 to use passive on ear detection to determine whether or not earbud 120 is located on or in an ear of a user. Passive on ear detection refers to an on ear detection process that does not require audio to be emitted via speaker 128, but instead uses the sounds detected in the ambient acoustic environment to make an on ear determination. Module 310 is configured to receive signals from proximity sensor 129, as well as passive signals $X_{RP}$ and $X_{EP}$ from microphones 121 and 122. The signal received from proximity sensor 129 may indicate whether or not earbud 120 is in proximity to an object. If the signal received from proximity sensor 129 indicates that earbud 120 is in proximity to an object, passive on ear detection module 310 may be configured to cause processor 124 to process passive signals $X_{RP}$ and $X_{EP}$ to determine whether earbud 120 is located in or on an ear of a user. According to some embodiments where earbud 120 does not comprise a proximity sensor 129, earbud 120 may instead perform passive on ear detection constantly or periodically based on a predetermined time period, or based on some other input signal being received.

Processor 124 may perform passive on ear detection by measuring and comparing the power of passive signals $X_{RP}$ and $X_{EP}$. If the power of passive signal $X_{RP}$ received from reference microphone 121 is high, but the power of passive signal $X_{EP}$ received from error microphone 122 is low, processor 124 may determine that earbud 120 is located in or on an ear of a user. According to some embodiments, processor 124 may consider that the power of passive signal $X_{RP}$ received from reference microphone 121 is high, and that the power of passive signal $X_{EP}$ received from error microphone 122 is low if the threshold difference between the two signals is greater than 8 dB, for example. This may correspond to a scenario in which reference microphone 121 is detecting ambient noise, but this ambient noise is occluded from error microphone 122 due to error microphone 122 being located within an ear canal. If the power of passive signal $X_{RP}$ received from reference microphone 121 is high and the power of passive signal $X_{EP}$ received from error microphone is also high, processor 124 may determine that earbud 120 is located outside an ear of a user. According to some embodiments, processor 124 may consider that the power of passive signal $X_{RP}$ received from reference microphone 121 is high, and that the power of passive signal $X_{EP}$ received from error microphone 122 is also high if the threshold difference between the two signals is less than 8 dB and that the power of both signals is above a predetermined threshold, which may be around 70 dBSPL, for example. This may correspond to a scenario in which reference microphone 121 and error microphone 122 are both detecting ambient noise. The results of this determination may be sent to decision module 340 for further processing. However, if the power of passive signal $X_{RP}$ received from reference microphone 121 is low, processor 124 may be unable to make a determination regarding the on-ear state of earbud 120. This may correspond to a scenario in which there is little or no ambient noise, and so both microphones 121 and 122 may generate a low signal. A low signal may be a signal below 70 dBSPL, for example.

If a determination cannot be made by passive on ear detection module 310, passive on ear detection module 310 may send a signal to active on ear detection module 320 to indicate that passive on ear detection was unsuccessful. According to some embodiments, even where passive on ear detection module 310 can make a determination, passive on ear detection module 310 may send a signal to active on ear detection module 320 to initiate active on ear detection, which may be used to confirm the determination made by passive on ear detection module 310, for example.

Active on ear detection module 320 may be executable by processor 124 to use active on ear detection to determine whether or not earbud 120 is located on or in an ear of a user. Active on ear detection refers to an on ear detection process that requires audio to be emitted via speaker 128 to make an on ear determination. Module 320 may be configured to cause speaker 128 to play a sound, to receive active signal $X_{EA}$ from error microphone 122 in response to the played sound, and to cause processor 124 to process active signal $X_{EA}$ with reference to the played sound to determine whether earbud 120 is located in or on an ear of a user. According to some embodiments, module 320 may also optionally receive and process active signal $X_{RA}$ from reference microphone 121, as described below in further detail with reference to FIGS. 5 to 7B.

Processor 124 executing active on ear detection module 320 may first be configured to instruct signal generation module 330 to generate a probe signal to be emitted by speaker 128. According to some embodiments, the generated probe signal may be an audible probe signal, and may be a chime signal, for example. According to some embodiments, the probe signal may be a signal of a frequency known to resonate in the human ear canal. For example, according to some embodiments, the signal may be of a frequency between 100 Hz and 2 kHz. According to some embodiments, the signal may be of a frequency between 200 and 400 Hz. According to some embodiments, the signal may comprise the notes C, D and G, being a Csus2 chord.

Microphone 121 may generate active signal $X_{EA}$ during the period that speaker 128 is emitting the probe signal. Active signal $X_{EA}$ may comprise a signal corresponding at least partially to the probe signal emitted by speaker 128.

Once speaker 128 has emitted the signal generated by signal generation module 330, and microphone 122 has generated active signal $X_{EA}$, being the signal generated based on audio sensed by microphone 122 during the emission of the generated signal by speaker 128, signal $X_{EA}$ is processed by processor 124 executing active on ear detection module 320 to determine whether earbud 120 is on or in an ear of a user. Processor 124 may perform active on ear detection by detecting whether or not error microphone 122 detected resonance of the probe signal emitted by speaker 128, by comparing the probe signal with active signal $X_{EA}$. This may comprise determining whether a resonance gain of the detected signal exceeds a predetermined threshold. If processor 124 determines that active signal $X_{EA}$ correlates with resonance of the probe signal, processor 124 may determine that microphone 122 is located within an ear canal of a user, and that earbud 120 is therefore located on or in an ear of a user. If processor 124 determines that active signal $X_{EA}$ does not correlate with resonance of the probe signal, processor 124 may determine that microphone 122 is not located within an ear canal of a user, and that earbud 120 is therefore not located on or in an ear of a user. The results of this determination may be sent to decision module 340 for further processing.

Once an on ear decision has been generated by one of passive on ear detection module 310 and active on ear detection module 320 and passed to decision module 340, processor 124 may execute decision module 340 to determine whether any action needs to be performed as a result of the determination. According to some embodiments, decision module 340 may also store historical data of previous states of earbud 120 to assist in determining whether any action needs to be performed. For example, if the determination is that earbud 120 is now in an in-ear position, and previously stored data indicates that earbud 120 was previously in an out-of-ear position, decision module 340 may determine that audio should now be delivered to earbud 120.

Figure 4:
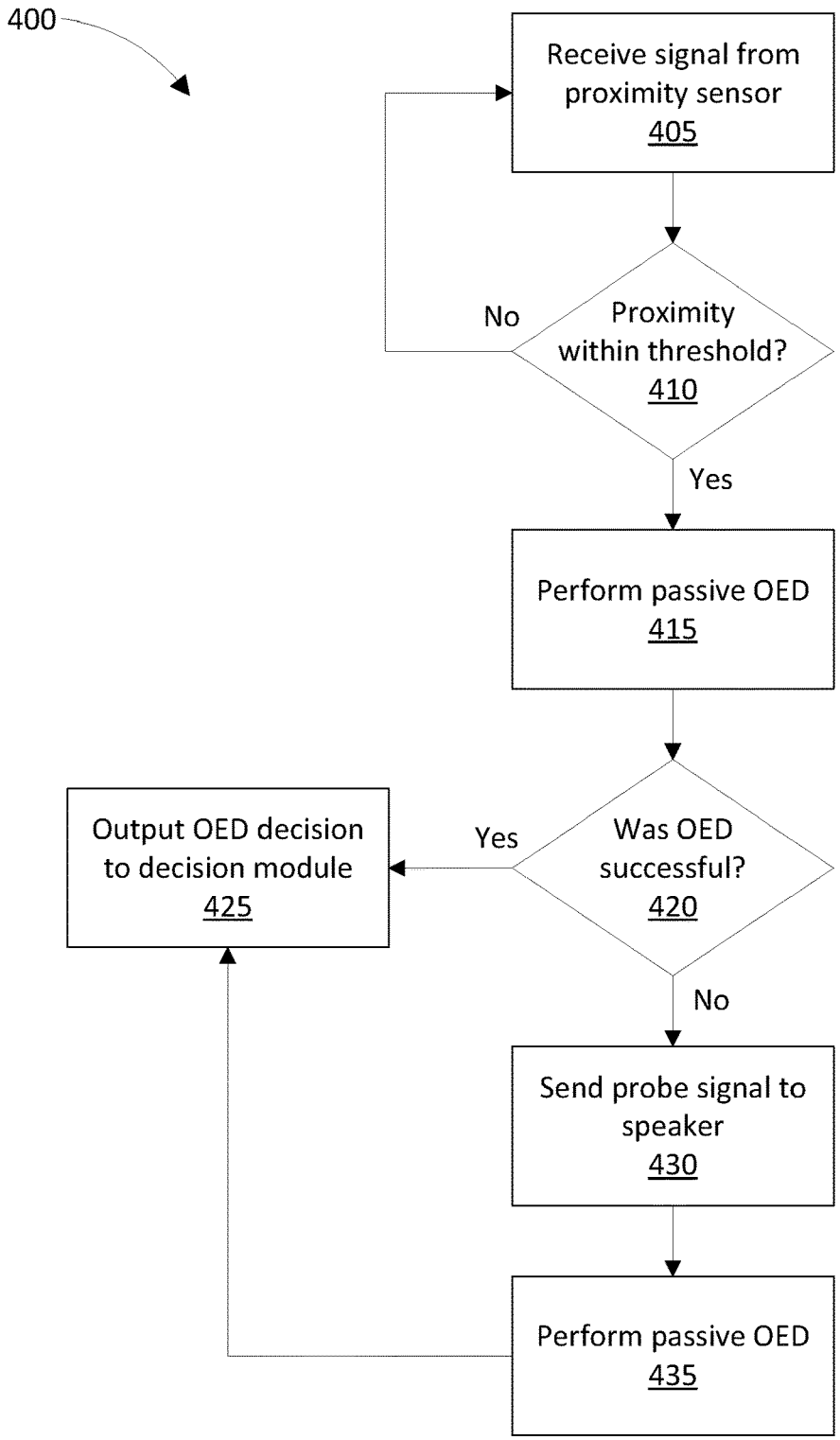
FIG. 4 shows a flowchart illustrating a method of determining whether or not a headset is in place on or in an ear of a user, as performed by the system of FIG. 1.

FIG. 4 is a flowchart illustrating a method 400 of on ear detection using earbud 120. Method 400 is performed by processor 124 executing code modules 310, 320, 330 and 340 stored in memory 125.

Method 400 starts at step 405, at which processor 124 receives a signal from proximity sensor 129. At step 410, processor 124 analyses the received signal to determine whether or not the signal indicates that earbud 120 is in proximity to an object. This analysis may include comparing the received signal to a predetermined threshold value, which may be a distance value in some embodiments. If processor 124 determines that the received signal indicates that earbud 120 is not in proximity to an object, processor 124 determines that earbud 120 cannot be located in or on an ear of a user, and so proceeds to wait for a further signal to be received from proximity sensor 129.

If, on the other hand, processor 124 determines from the signal received from proximity sensor 129 that earbud 120 is in proximity to an object, processor 124 continues to execute method 400 by proceeding to step 415. In embodiments where earbud 120 does not include a proximity sensor 129, steps 405 and 410 of method 400 may be skipped, and processor 124 may commence executing the method from step 415. According to some embodiments, a different sensor, such as a motion sensor, may be used to trigger the performance of method 400 from step 515.

At step 415, processor 124 executes passive on ear detection module 310 to determine whether earbud 120 is located in or on an ear of a user. As described in further detail above with references to FIG. 3, executing passive on ear detection module 310 may comprise processor 124 receiving and comparing the power of passive signals $X_{RP}$ and $X_{EP}$ generated by microphones 121 and 122 in response to received ambient noise.

At step 420, processor 124 checks whether the passive on ear detection process was successful. If processor 124 was able to determine whether earbud 120 is located in or on an ear of a user based on passive signals $X_{RP}$ and $X_{EP}$, then at step 425 the result is output to decision module 340 for further processing. If processor 124 was unable to determine whether earbud 120 is located in or on an ear of a user based on passive signals $X_{RP}$ and $X_{EP}$, then processor 124 proceeds to execute an active on ear detection process by moving to step 430.

At step 430, processor 124 executes signal generation module 330 to cause a probe signal to be generated and sent to speaker 128 for emission. At step 435, processor 124 further executes active on ear detection module 320. As described in further detail above with references to FIG. 3, executing active on ear detection module 320 may comprise processor 124 receiving active signal $X_{EA}$ generated by microphone 122 in response to the emitted probe signal, and determining whether the received signal corresponds to resonance of the probe signal. According to some embodiments, as described in further detail below with reference to FIGS. 5 to 7B, executing active on ear detection module 320 may further comprise processor 124 receiving active signal $X_{RA}$ generated by microphone 121 in response to the emitted probe signal, and determining whether the received signal corresponds to resonance of the probe signal. At step 425, the result of the active on ear detection process is output to decision module 340 for further processing.

Figure 5:
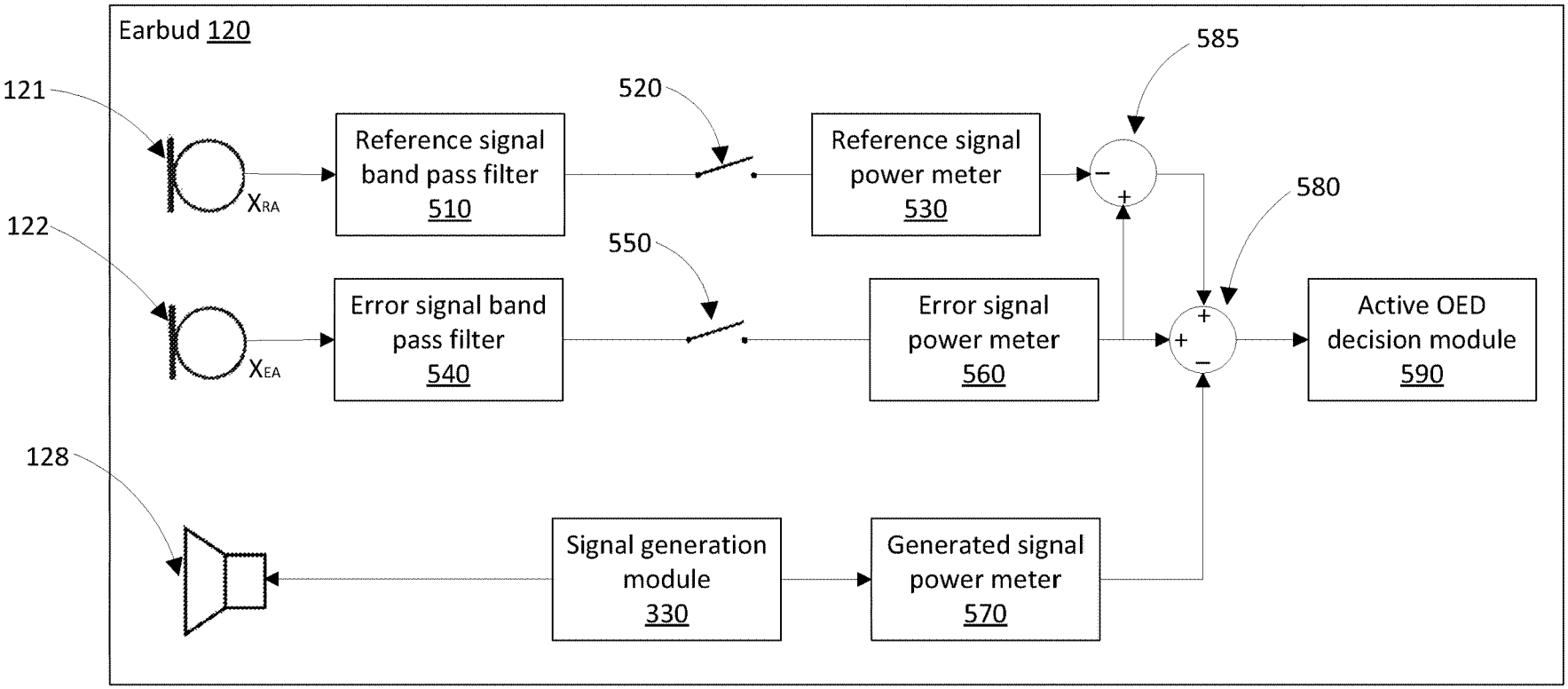
FIG. 5 shows a block diagram showing the active on ear detection process of the method of FIG. 4 in further detail.

FIG. 5 shows a block diagram illustrating components of earbud 120 in further detail, specifically with reference to an alternative method for performing active on ear detection that may be performed by processor 124 executing active on ear detection module 320. As described below with reference to FIGS. 6A to 7B, some previous techniques for active on ear detection only look for resonance on the internal microphone, being error microphone 122, and can therefore be prone to false positives in some cases, such as where earbud 120 is held in a resonating chamber such as a tightly cupped hand or another small contained environment. The method shown in FIG. 5 also considers resonance of the external microphone, being reference microphone 121, which may avoid false positives in some scenarios.

FIG. 5 shows microphones 121 and 122, as well as speaker 128. When audio is being played via speaker 128, reference microphone 121 generates active signal $X_{RA}$ based on detected sounds, which may include ambient sounds as well as sounds emitted by speaker 128, and error microphone 122 generates active signal $X_{EA}$ based on detected sounds, which may include ambient sounds as well as sounds emitted by speaker 128.

The audio played by speaker 128 is generated by signal generation module 330. According to some embodiments, for an active on ear detection method to be performed, signal generation module 330 may generate a probe signal. The probe signal may be an audible probe signal, and may be a chime signal, for example. According to some embodiments, the probe signal may be a signal of a frequency known to resonate in the human ear canal. For example, according to some embodiments, the signal may be of a frequency between 100 Hz and 2 kHz. According to some embodiments, the signal may be of a frequency between 200 and 400 Hz. According to some embodiments, the signal may comprise the notes C, D and G, being a Csus2 chord.

Microphones 121 and 122 may detect the signal emitted by speaker 128, along with any other background or ambient noise. Microphones 121 and 122 may generate active signals $X_{RA}$ and $X_{EA}$ based on the detected sound, and pass these signals respectively to reference signal band pass filter 510 and error signal band pass filter 540. Band pass filters 510 and 540 may apply a band pass filter to the received signals $X_{RA}$ and $X_{EA}$, which may be a narrow band pass filter in some embodiments. According to some embodiments, filters 510 and 540 may apply a narrow 4th order bandpass filter. According to some embodiments, the parameters of band pass filters 510 and 540 may be set based on the frequency of the probe signal generated by signal generation module 330. For example, according to some embodiments, filters 510 and 540 may apply a filter with a bandpass of 260 to 300 Hz to signals $X_{RA}$ and $X_{EA}$, which may match a probe signal comprising the notes C and D. Using a matched filter may reduce the sensitivity of the system to external noise, avoiding large power readings being detected based on external sounds that may occur at the same time as the emission of the probe signal.

The filtered signals may be passed to reference signal power meter 530 and error signal power meter 560 via switches 520 and 550, respectively. Switched 520 and 550 may be configured to shut only after a predetermined time period has elapsed since speaker 128 first started emitting the generated probe signal. This may allow the signals detected and generated by microphones 121 and 122 to settle. For example, according to some embodiments, switches 520 and 550 may be configured to close 100 ms after speaker 128 starts emitting the probe signal.

Once switches 520 and 550 are closed, the filtered signals generated by band pass filters 510 and 540 are passed to power meters 530 and 560. Meters 530 and 560 are configured to measure and output a power level of the received filtered signals. The measured power levels are provided to summing node 585. Summing node 585 subtracts the power level value determined by power meter 530 from the measured power level determined by power meter 560. The result is passed to summing node 580, which also receives a power level value from generated signal power meter 570, which is configured to measure and output the power level of the probe signal generated by signal generation module 330 and emitted by speaker 128. Summing node 580 adds the output of summing node 585 with the measured power level determined by power meter 560, and subtracts the power level value determined by generated signal power meter 570. In some embodiments, the measured power level determined by power meter 560 may be added at summing node 585 with a gain of two and not added at summing node 580, which would achieve the same result.

The result of summing node 580 is passed to active on ear detection decision module 590. Decision module 590 compares the received result to a predetermined threshold value to determine whether or not earbud 120 is located on or in an ear of a user. Specifically, if the received result is equal to or above the predetermined threshold, earbud 120 is determined to be on or in an ear of a user, and if the received result is below the predetermined threshold, earbud 120 is determined to be off ear.

In practice, when earbud 120 is located in or on an ear of a user such that error microphone 122 is located within the ear canal of the ear, error microphone 122 will detect a high power signal due to the probe signal emitted by speaker 128 and resonated by the ear canal. Reference microphone 121 is occluded from speaker 128 and will only detect a low power signal. Subtracting the signal received by reference microphone 121 from the signal received by microphone 122 will therefore result in a relatively high signal level, which will be above the predetermined threshold, allowing processor 124 to correctly determine that earbud 120 is located in or on an ear of a user.

When earbud 120 is located outside an ear of a user and in an open space such that reference microphone 121 and error microphone 122 are both outside the ear canal of the ear or any other resonating chamber, neither reference microphone 121 nor error microphone 122 will detect a high power signal due to the probe signal emitted by speaker 128, as this signal will not resonate prior to reaching microphones 121 and 122. The signals received by microphones 121 and 122 are likely to be substantially equal, and subtracting the signal received by reference microphone 121 from the signal received by microphone 122 will therefore result in a relatively low signal level, which will be below the predetermined threshold, allowing processor 124 to correctly determine that earbud 120 is located outside an ear of a user.

When earbud 120 is located outside an ear of a user but inside a resonating chamber, such as in the closed hand of a user, such that reference microphone 121 and error microphone 122 are both inside a resonating chamber, both reference microphone 121 and error microphone 122 will detect a high power signal due to the probe signal emitted by speaker 128, as this signal will resonate within the chamber. The signals received by microphones 121 and 122 are likely to be substantially equal, and subtracting the signal received by reference microphone 121 from the signal received by microphone 122 will therefore result in a relatively low signal level, which will be below the predetermined threshold, allowing processor 124 to correctly determine that earbud 120 is located outside an ear of a user. This method may therefore reduce false positives created by resonance produced by placing earbud 120 in resonating chambers or areas outside the ear.

Figure 6A:
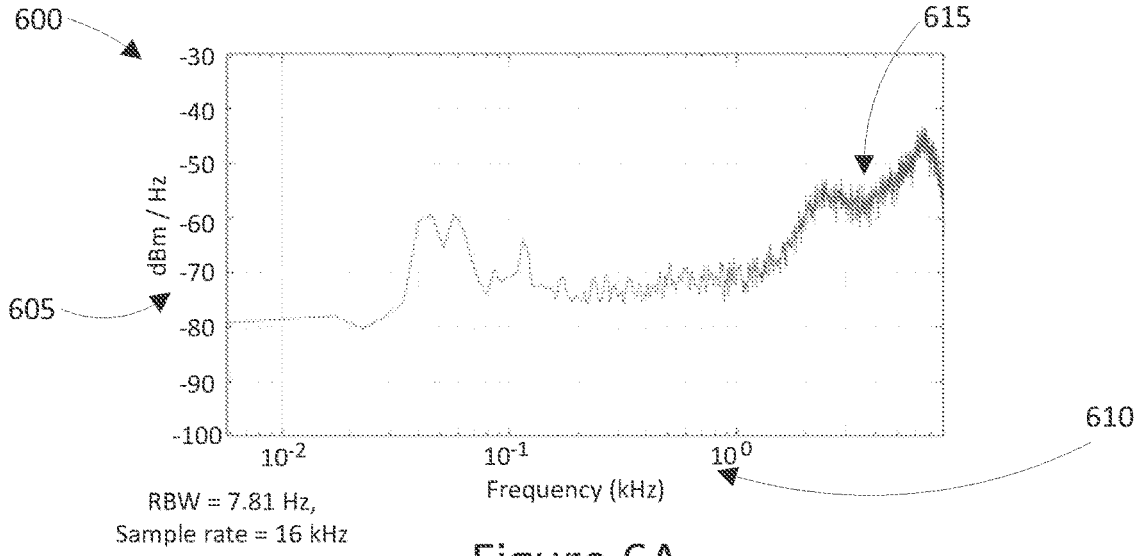
FIGS. 6A to 6C show graphs illustrating the signals measured by an internal microphone of the system of FIG. 1.
Figure 6B:
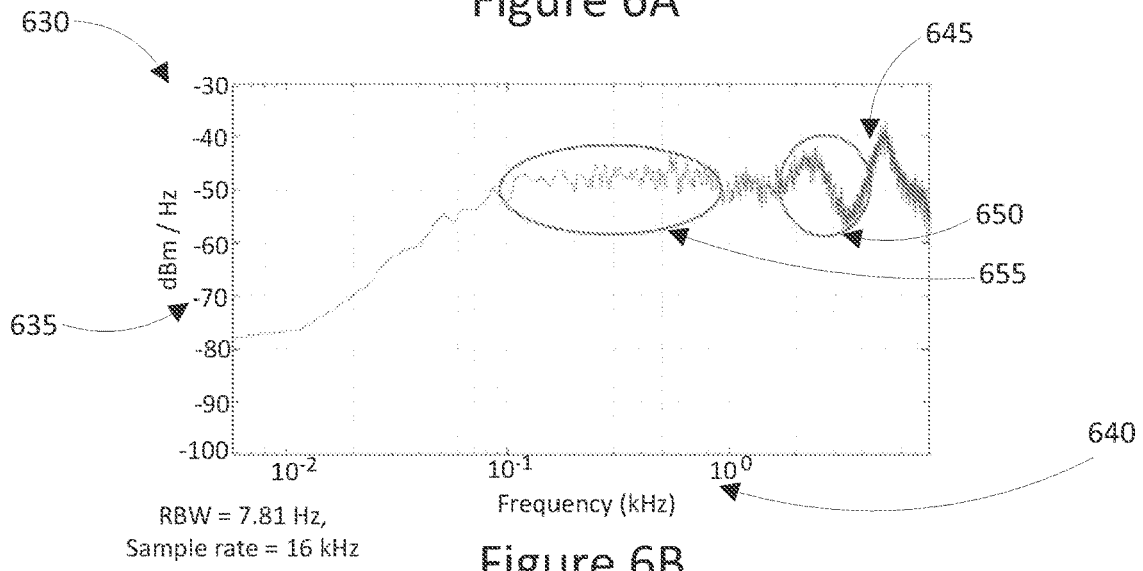
Figure 6C:
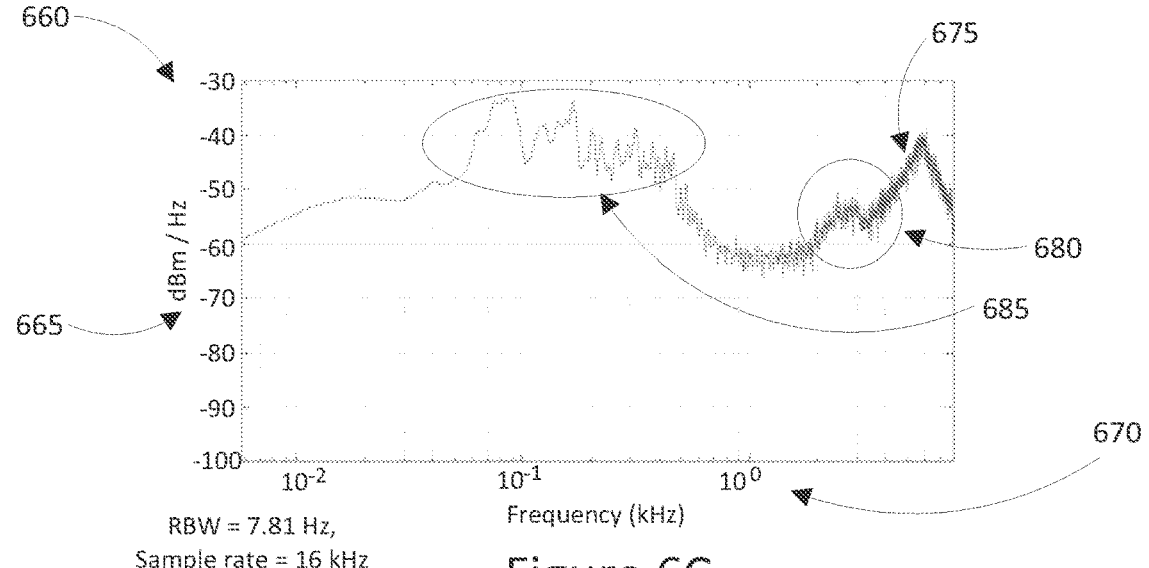

FIGS. 6A to 6C are graphs illustrating the signals measured by microphones placed in the open, within an ear, and within an enclosed hand, respectively.

FIG. 6A shows a graph 600 showing a signal 615 against an X-axis 610 and a Y-axis 605. X-axis 610 displays frequency in kHZ, while Y-axis 605 displays power spectral density in dBm/Hz. Signal 615 is generated by an internal earbud microphone such as microphone 122 of earbud 120 when earbud 120 is located in an open space and speaker 128 is emitting a probe signal. Signal 615 is sampled at a sampling rate of 16 kHz, with a resolution bandwidth of 7.81 Hz.

In contrast, FIG. 6B shows a graph 630 showing a signal 645 against an X-axis 640 and a Y-axis 635. X-axis 640 displays frequency in kHz, while Y-axis 635 displays power spectral density in dBm/Hz. Signal 645 is generated by an internal earbud microphone such as microphone 122 of earbud 120 when earbud 120 is located in an ear of a user and speaker 128 is emitting a probe signal. Signal 615 is sampled at a sampling rate of 16 kHz, with a resolution bandwidth of 7.81 Hz. As seen when comparing graph 630 with graph 600, there are a number of differences that occur in the recorded signal when earbud 120 is located in an ear as opposed to in an open space. For example, as illustrated by feature 655, signal 645 experiences an increase in level between 100 Hz and 1 kHz when compared to signal 615. As illustrated by feature 650, signal 645 also experiences a peak at around 2.5 kHz, followed by a trough at around 3.5 kHz.

FIG. 6C shows a graph 660 showing a signal 675 against an X-axis 670 and a Y-axis 665. X-axis 670 displays frequency in kHz, while Y-axis 665 displays power spectral density in dBm/Hz. Signal 675 is generated by an internal earbud microphone such as microphone 122 of earbud 120 when earbud 120 is located in a resonating chamber, such as a tightly cupped hand, and speaker 128 is emitting a probe signal. Signal 675 is sampled at a sampling rate of 16 kHz, with a resolution bandwidth of 7.81 Hz. As seen when comparing graph 660 with graphs 600 or 630, placing earbud 120 in a tightly cupped hand can produce features similar to those seen in signal 645 correlating to earbud 120 being located in an ear. Specifically, as illustrated by feature 685, signal 675 also experiences an increase in level between 100 Hz and 1 kHz, and as illustrated by feature 680, signal 675 also experiences a small peak at around 2.5 kHz, followed by a small trough at around 3.5 kHz.

Figure 7A:
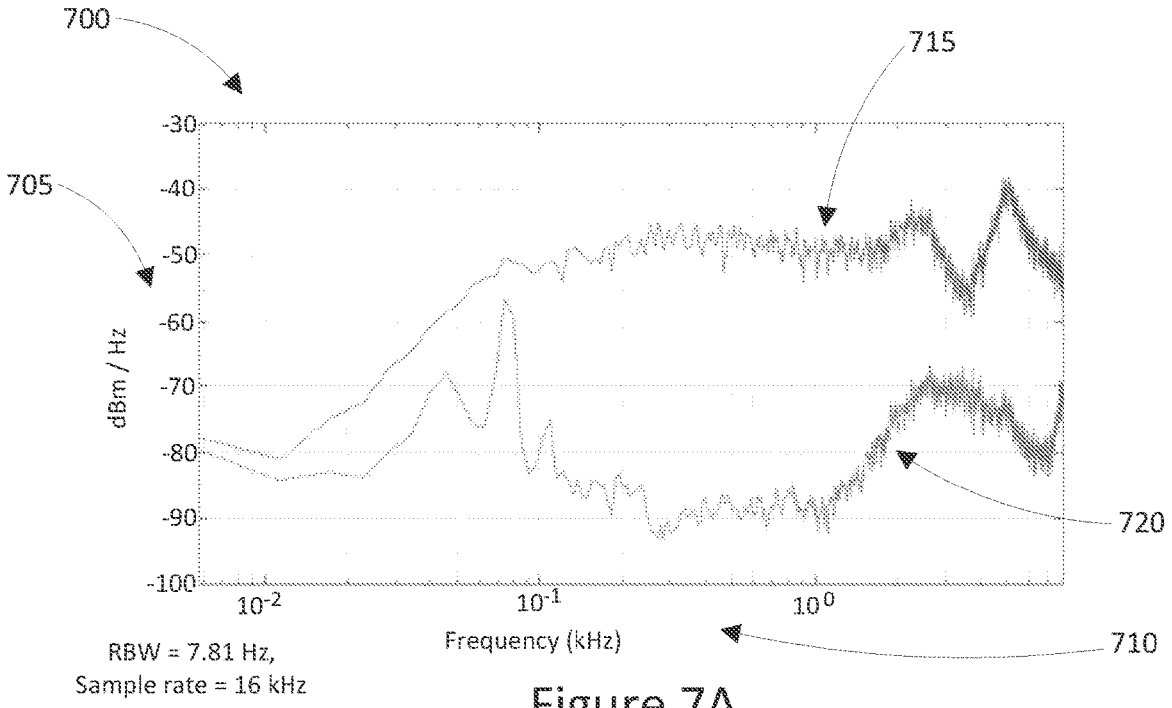
FIGS. 7A to 7B show graphs illustrating the signals measured by an internal microphone and an external microphone of the system of FIG. 1.
Figure 7B:
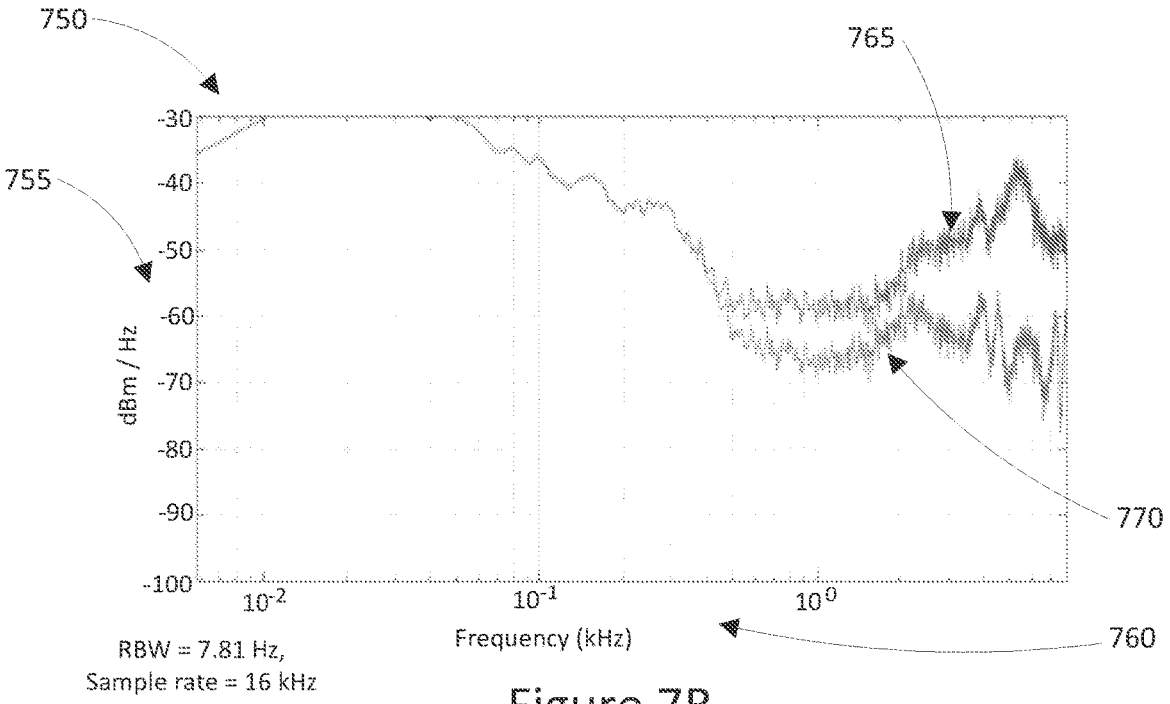

As described above, this can be resolved by also looking at the signal produced by external microphone 121. FIGS. 7A and 7B are graphs illustrating the signals measured by microphones placed within an ear and within an enclosed hand, respectively, but showing signals from both internal and external microphones.

FIG. 7A shows a graph 700 showing a signal 715 against an X-axis 710 and a Y-axis 705. X-axis 710 displays frequency in kHZ, while Y-axis 705 displays power spectral density in dBm/Hz. Signal 715 is generated by an internal earbud microphone such as microphone 122 of earbud 120 when earbud 120 is located in an ear of a user and speaker 128 is emitting a probe signal. Graph 700 also shows a signal 720 which is generated by an external earbud microphone such as microphone 121 of earbud 120 when earbud 120 is located in an ear of a user and speaker 128 is emitting a probe signal. Signals 715 and 720 are sampled at a sampling rate of 16 kHz, with a resolution bandwidth of 7.81 Hz. FIG. 7B shows a graph 750 showing a signal 765 against an X-axis 760 and a Y-axis 755. X-axis 760 displays frequency in kHZ, while Y-axis 755 displays power spectral density in dBm/Hz. Signal 765 is generated by an internal earbud microphone such as microphone 122 of earbud 120 when earbud 120 is located a resonating chamber, such as a tightly cupped hand, and speaker 128 is emitting a probe signal. Graph 700 also shows a signal 770 which is generated by an external earbud microphone such as microphone 121 of earbud 120 when earbud 120 is located in a resonating chamber, such as a tightly cupped hand, and speaker 128 is emitting a probe signal. Signals 765 and 770 are sampled at a sampling rate of 16 kHz, with a resolution bandwidth of 7.81 Hz.

As seen when comparing graph 700 with graph 750, there are similarities in signals 715 and 765, making it difficult to tell based on internal microphone 122 alone whether earbud 120 is within an ear or within a tightly cupped hand. However, signals 720 and 770 differ more significantly, with the increased level of signal 770 showing that earbud 120 is likely to not actually be within an ear in the scenario shown in graph 750.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A signal processing device for on ear detection for an earbud, the device comprising:

a first microphone input for receiving a microphone signal from a first microphone, the first microphone being configured to be positioned within an ear of a user when the earbud is being worn;

a second microphone input for receiving a microphone signal from a second microphone, the second microphone being configured to be positioned outside the ear of the user when the earbud is being worn;

a signal generator configured to generate a signal for acoustic playback from a speaker configured to be positioned within the earbud; and a processor configured to:

receive at least one first microphone signal from each of the first microphone input and the second microphone input where the first microphone signals are generated while no audio is being played via the speaker, and compare the first microphone signals to determine an on ear status of the earbud;

determine that the on ear status of the earbud cannot be sufficiently determined, generate the signal for acoustic playback from the speaker, receive a second microphone signal from the first microphone input, and compare the second microphone signal to the generated signal to determine the on ear status of the earbud.

2. The signal processing device of claim 1, further comprising a proximity sensor, and wherein the processor is further configured to receive at least one sensor signal from the proximity sensor indicating that the earbud is in proximity to an object, and to perform the steps of receiving at least one first microphone signals and comparing the first microphone signals to determine the on ear status of the earbud in response to receiving the at least one sensor signal from the proximity sensor.

3. The signal processing device of claim 2, wherein the proximity sensor is an infra-red sensor.

4. The signal processing device of claim 1, wherein comparing the first microphone signals to determine the on ear status of the earbud comprises comparing a power level of the first microphone signals.

5. The signal processing device of claim 4, wherein comparing the first microphone signals to determine the on ear status of the earbud further comprises determining that the earbud is on ear if the power of the first microphone signal received from the first microphone is lower than the first microphone signal received from the second microphone by a predetermined threshold.

6. The signal processing device of claim 4, wherein comparing the first microphone signals to determine the on ear status of the earbud further comprises determining that the earbud is off ear if the power of the first microphone signal received from the first microphone is higher than the first microphone signal received from the second microphone by a predetermined threshold.

7. The signal processing device of claim 4, wherein comparing the first microphone signals to determine the on ear status of the earbud further comprises determining that the on ear status of the earbud cannot be sufficiently determined if the power level of each of the first microphone signals is lower than a predetermined threshold.

8. The signal processing device of claim 1, wherein comparing the second microphone signal to the generated signal to determine the on ear status of the earbud comprises determining whether the at least one second microphone signal comprises resonance of the generated signal.

9. The signal processing device of claim 1, wherein the generated signal is an audible probe signal.

10. The signal processing device of claim 9, wherein the generated signal is of a frequency known to resonate in the human ear canal.

11. The signal processing device of claim 1, wherein the processor is further configured to perform an audio processing function in response to the determined on ear status of the earbud.

12. A method of on ear detection for an earbud, the method comprising:

receiving a first microphone signal from a first microphone and a first microphone signal from a second microphone where the first microphone signals are generated while no audio is being played via a speaker configured to be positioned within the earbud, wherein the first microphone is configured to be positioned within an ear of a user when the earbud is being worn and the second microphone is configured to be positioned outside the ear of the user when the earbud is being worn;

comparing the first microphone signals to determine an on ear status of the earbud;

determining that the on ear status of the earbud cannot be sufficiently determined, generating a signal for acoustic playback from the speaker, receiving a second microphone signal from the first microphone, and comparing the second microphone signal to the generated signal to determine the on ear status of the earbud.

13. The method of claim 12, further comprising performing an audio processing function in response to the determined on ear status of the earbud.

14. A signal processing device for on ear detection of an earbud, the device comprising:

a first microphone input for receiving a microphone signal from a first microphone, the first microphone being configured to be positioned within an ear of a user when the earbud is being worn;

a second microphone input for receiving a microphone signal from a second microphone, the second microphone being configured to be positioned outside the ear of the user when the earbud is being worn;

a signal generator configured to generate a signal for acoustic playback from a speaker configured to be positioned within the earbud; and a processor configured to:

generate the signal for acoustic playback from the speaker;

cause the signal to be played by the speaker;

receive at least one microphone signal from each of the first microphone input and the second microphone input, and compare the received microphone signals with the generated signal played by the speaker to detect resonance of the generated signal; and determine an on ear status of the earbud;

wherein the earbud is determined to be on ear only if the resonance is detected in the signal from the first microphone input but is not detected in the signal from the second microphone input.

15. The signal processing device of claim 14, wherein the generated signal is an audible probe signal.

16. The signal processing device of claim 15, wherein the generated signal is of a frequency known to resonate in the human ear canal.

17. The signal processing device of claim 14, wherein the processor is further configured to filter the received microphone signals with a bandpass filter prior to comparing the received microphone signals.

18. The signal processing device of claim 17, wherein the bandpass filter is matched to the frequency of the generated signal.

19. The signal processing device of claim 17, wherein the processor is configured to only compare the filtered signals after a predetermined time period has elapsed from a time at which the generated signal was emitted from the speaker.

20. The signal processing device of claim 14, wherein comparing the received microphone signals with the generated signal played by the speaker to detect resonance of the generated signal comprises subtracting a power level of the microphone signal received from the second microphone and a power level of the generated signal from the power level of the microphone signal received from the first microphone, and comparing the resultant power level with a predetermined threshold.

21. The signal processing device of claim 14, wherein the processor is further configured to perform an audio processing function in response to the determined on ear status of the earbud.

22. A method for on ear detection of an earbud, the method comprising:

generating a signal for acoustic playback from a speaker configured to be positioned within the earbud;

causing the signal to be played by the speaker;

receiving at least one microphone signal from a first microphone and a second microphone, wherein the first microphone is configured to be positioned within an ear of a user when the earbud is being worn and the second microphone is configured to be positioned outside the ear of the user when the earbud is being worn;

comparing the received microphone signals with the generated signal played by the speaker to detect resonance of the generated signal; and determining an on ear status of the earbud, wherein the earbud is determined to be on ear only if the resonance is detected in the signal from the first microphone but is not detected in the signal from the second microphone.

23. A machine-readable medium storing non-transitory instructions which, when executed by one or more processors, cause an electronic apparatus to perform the method of claim 12.

24. An apparatus, comprising processing circuitry and a non-transitory machine-readable which, when executed by the processing circuitry, cause the apparatus to perform the method of claim 12.

25. A system for on ear detection for an earbud, the system comprising a processor and a memory, the memory containing instructions executable by the processor and wherein the system is operative to perform the method of claim 12.

* * * * *